US005565968A

United States Patent [19]

Sawa et al.

[11] Patent Number: 5,565,968

[45] Date of Patent: Oct. 15, 1996

[54] DEVELOPING ROLLER, AND METHOD AND APPARATUS FOR DEVELOPING LATENT IMAGES USING THE ROLLER

[75] Inventors: Eiji Sawa, Fujisawa; Ryuta Tanaka, Yokohama; Yuichiro Mori, Yokohama; Tokuo Okada, Yokohama; Yoshio Takizawa, Fussa; Koji Takagi, Kodaira; Takahiro Kawagoe, Tokorozawa, all of Japan

[73] Assignee: Bridgestone Corporation, Tokyo, Japan

[21] Appl. No.: 523,041

[22] Filed: Sep. 1, 1995

[30] Foreign Application Priority Data

| | | | |
|---|---|---|---|
| Sep. 2, 1994 | [JP] | Japan | 6-210041 |
| Dec. 26, 1994 | [JP] | Japan | 6-323376 |
| Feb. 15, 1995 | [JP] | Japan | 7-050524 |
| Feb. 15, 1995 | [JP] | Japan | 7-050525 |

[51] Int. Cl.[6] ..... G03G 15/08

[52] U.S. Cl. ..... 355/259; 118/653; 430/120

[58] Field of Search ..... 355/259, 251; 118/653, 657, 658; 430/101, 120

[56] References Cited

FOREIGN PATENT DOCUMENTS

| | | | |
|---|---|---|---|
| 59-160162 | 9/1984 | Japan | 355/259 |
| 1-102486 | 4/1989 | Japan | 355/259 |
| 3-12673 | 1/1991 | Japan | 355/259 |

*Primary Examiner*—Joan H. Pendegrass

*Attorney, Agent, or Firm*—Sughrue, Mion, Zinn, Macpeak & Seas

[57] ABSTRACT

A developing roller comprising a conductive layer formed around a shaft carries a non-magnetic one-component developer on its outer surface to form a thin film of the developer and contacts a photoconductor drum having an electrostatic latent image borne on its surface whereby the latent image is developed to form a toner image. In one embodiment, the surface of the conductive layer has a DIN 4776 core roughness depth Rk of 0.5–3.5 μm in a circumferential direction of the roller, and the ratio of circumferential Rk to axial Rk is greater than 1.0. In another embodiment, the surface of the conductive layer is provided with microscopic ridges and recesses which are alternately disposed in a rotational direction to define wavy streaks having a longitudinal direction substantially aligned with an axial direction of the roller.

20 Claims, 8 Drawing Sheets

DEVELOPING ROLLER, AND METHOD AND APPARATUS FOR DEVELOPING LATENT IMAGES USING THE ROLLER

BACKGROUND OF THE INVENTION

1. Field of the Invention

This invention relates to a developing roller for use in electrophotographic and electrostatic recording apparatus such as copying machines and printers. It also relates to a method and apparatus for developing electrostatic latent images using the developing roller.

2. Prior Art

With the recent advance of electrophotography, severer requirements are imposed on conductive members used in various steps of the electrophotographic process. The developing roller used in the developing device is one of such important conductive members. The developing roller is required to have a desired electrical resistance and adequate characteristics for various developing mechanisms.

In the prior art electrophotographic process, a method is employed for developing electrostatic latent images using a non-magnetic one-component developer as a developer or toner. One typical developing method is an impression developing method wherein a donor roller receiving a toner is placed in pressure contact with a photoconductor drum having a latent image borne thereon whereby the toner is delivered from the donor roller to the drum, adhering the toner to the latent image on the drum to form a visible toner image. This method allows for simplification and size reduction of apparatus and the use of color toner because no magnetic material is needed.

The impression developing method requires the developing roller to be formed of a conductive elastomer since development is carried out by placing the developing roller having a toner carried thereon in pressure contact with the photoconductor drum having a latent image borne thereon, thereby causing the toner to adhere to the latent image on the drum.

Referring to FIG. 1, the impression developing method is illustrated. A developing roller 1 is placed between a toner feed roller 4 for feeding a toner 6 and a photoconductor drum 5 having an electrostatic latent image borne thereon and in contact with the photoconductor drum 5. Upon rotation of the developing roller 1, photoconductor drum 5, and toner feed roller 4, the toner 6 is fed from the feed roller 4 onto the surface of the developing roller 1 and regulated into a uniform thin layer by a doctor blade 7. The thin layer of toner is then delivered from the developing roller 1 to the photoconductor drum 5 to adhere to the latent image whereby the latent image is developed into a visible toner image. The toner image is finally transferred from the photoconductor drum 5 to a record medium, typically paper in a transfer section 8. Also included is a cleaning section 9 having a cleaning blade 10 for scraping off the toner left on the photoconductor drum 5 after the transfer step.

During rotation, the developing roller 1 must maintain close contact with the photoconductor drum 5. Then the conventional developing roller 1 is of a structure having a conductive layer 3 around a shaft 2 as shown in FIG. 2. The shaft 2 is of a highly conductive material, typically metal. The conductive layer 3 is formed of a conductive elastomer in the form of an elastic rubber such as silicone rubber, acrylonitrile-butadiene rubber (NBR), and ethylene-propylene-diene terpolymer (EPDM) or a sponge such as urethane foam, with a suitable conductive agent being blended therein. The developing roller 1 is prepared by applying the conductive elastomer onto the outer periphery of the shaft 2 to form the conductive layer 3 and grinding the surface of the conductive layer 3 with an abrasive wheel 11 as shown in FIG. 3.

However, the prior art development methods had the following problems resulting from the properties of developing rollers used therein. (1) The conductive layer 3 of the developing roller 1 which is formed of an elastic rubber such as silicone rubber, NBR and EPDM is readily abradable and thus susceptible to slight unevenness of grinding during the roller manufacturing process, which can result in positional variations in the amount of toner carried on the roller. (2) On long-term operation, as the developing roller on the surface is abraded away due to friction with the regulating blade and photoconductor drum, the developing roller surface is smoothened to reduce the amount of toner carried on the roller. (3) When a developing roller having a conductive elastomer layer of elastic rubber such as silicone rubber, NBR, EPDM and polyurethane resin around a conductive shaft is used without a surface or coating layer on the conductive elastomer layer, the developing roller has a higher coefficient of friction with the photoconductor drum or regulating blade, which requires a greater power for driving and prevents the relative speed of the developing roller and photoconductor drum from being stabilized, resulting in image variations. (4) One countermeasure to (3) is to form a surface or coating layer on the conductive elastomer layer for providing a reduced coefficient of friction, although no sufficient triboelectric charging of toner then takes place between the developing roller and the regulating blade, leading to the risk of image fogging. For the reasons (1) to (4), there arise problems such as density variations of a resultant image and character thinning after long-term operation. This tendency is outstanding particularly with the impression development method using a non-magnetic one-component toner.

SUMMARY OF THE INVENTION

The present invention is intended to overcome the above-mentioned problems associated with developing rollers upon developing electrostatic latent images borne on latent image-bearing bodies, typically photoconductor drums used in electrophotographic and electrostatic recording apparatus such as copying machines and printers by improving the surface state of the developing roller. An object of the present invention is to provide a developing roller which ensures production of images of quality free of density variations, fogging and character thinning even after long-term service. Another object of the present invention is to provide a method and apparatus for developing an electrostatic latent image using the developing roller.

Studying the surface state of a developing roller, the inventors have found that an appropriate amount of developer or toner can be carried on the roller by providing the roller on the surface with fine irregularities (consisting of ridges and recesses). If the irregularities are too large, the toner is carried in an increased amount, but charged in an uneven quantity. If the irregularities are too small, no adequate amount of toner can be carried on the roller and triboelectric charging becomes unlikely, failing to produce a desired quantity of toner charge. In this way, if the developing roller is provided on the surface with irregularities of inadequate size, then the amount of toner carried and/or the quantity of toner charge becomes short, resulting in image defects. Further investigating the surface state of a developing roller for optimization, the inventors have found that by controlling the surface state of a conductive layer of a developing roller such that the surface of the conductive layer has a core roughness depth Rk of 0.5 to 3.5 μm in a circumferential direction as prescribed in DIN 4776 standard and the circumferential Rk is greater than the axial Rk, the toner coverage on the developing roller and toner charge quantity can be maintained uniform and constant to ensure consistent production of images of quality.

Accordingly, in a first aspect, the present invention provides a developing roller comprising a highly conductive shaft and a conductive layer formed around the shaft and defining a cylindrical outer surface, wherein the surface of the conductive layer has a core roughness depth Rk of 0.5 to 3.5 μm in a circumferential direction of the roller and a core roughness depth Rk in an axial direction of the roller as prescribed in DIN 4776 standard, the ratio of the circumferential Rk to the axial Rk being greater than 1.0.

The inventors have also found for the developing roller which is provided on the surface with fine irregularities to carry an appropriate amount of toner on the roller that if microscopic irregularities or ridges and recesses are alternately disposed in the circumferential direction to define wavy streaks on the roller surface, it is more convenient for carrying the toner. If the wavy streaks are spaced at substantially fixed intervals in the circumferential direction, the toner can be carried more uniformly. As a result, there are produced images of quality free of density variations and background fogging. If this topography is maintained after long-term operation, it is more effective for stabilizing the amount of toner carried and image quality.

Accordingly, in a second aspect, the present invention provides a developing roller comprising a highly conductive shaft and a conductive layer formed around the shaft and defining a cylindrical outer surface, the roller having an axis and adapted to rotate about the axis in a circumferential rotational direction, wherein the surface of the conductive layer is provided with wavy streaks having a longitudinal direction substantially aligned with an axial direction, the wavy streaks comprising microscopic ridges and recesses alternately disposed in the rotational direction.

The developing roller can be rugged on the surface by grinding the surface of the conductive layer. The rugged surface has a number of fine fringy ridges which are tilted in one circumferential direction of the roller. If the developing roller is set such that the tilt direction of the fringy ridges may coincide with the rotational direction of the developing roller, a constant amount of toner can be carried on the roller, ensuring to produce images of quality free of density variations, background fog and character thinning even after long-term service.

More particularly, in developing a latent image by causing a developing roller to carry a toner on its outer surface to form a thin layer of the toner, causing a drum to bear an electrostatic latent image on its surface, and rotating the developing roller and the drum while placing the roller in proximity to or in contact with the drum, thereby supplying the toner to the latent image-bearing surface of the drum to develop the latent image into a toner image, it is possible to carry an adequate amount of toner on the developing roller by providing the developing roller on the surface with a number of fine fringy ridges. In this regard, it is convenient for providing a toner carrying capability that the fine fringy ridges are tilted in one circumferential direction which coincides with the rotational direction of the developing roller. There are produced images of quality free of density variations, background fog and character thinning even after long-term service.

Accordingly, in a third aspect, the present invention provides a method for developing a latent image comprising the steps of: causing a developing roller comprising a conductive layer around a highly conductive shaft to carry a developer on its outer surface to form a thin film of the developer, causing a drum to bear an electrostatic latent image on its surface, and rotating the developing roller and the drum while placing the roller in proximity to or in contact with the drum, thereby supplying the developer to the latent image-bearing surface of the drum to develop the latent image into a toner image. The method further includes the steps of providing the developing roller on the surface with a number of fine fringy ridges which are tilted in one circumferential direction and setting the developing roller such that the tilt direction of the fringy ridges may coincide with the rotational direction of the developing roller.

The present invention also provides an apparatus for developing a latent image comprising a rotatable drum adapted to bear an electrostatic latent image on its surface; a rotatable developing roller comprising a conductive layer around a highly conductive shaft, the developing roller being disposed in proximity to or in contact with the drum; means for supplying a developer to the developing roller to form a thin film of the developer on its outer surface; means for rotating the developing roller and the drum in proximate or close relationship; wherein the developer is supplied to the latent image-bearing surface of the drum to develop the latent image into a toner image; the developing roller being provided on the surface with a number of fine fringy ridges which are tilted in one circumferential direction and the developing roller being set such that the tilt direction of the fringy ridges may coincide with the rotational direction of the developing roller.

In contrast, if image defects associated with the coefficient of friction of the developing roller surface occur as previously pointed out as problems (3) and (4), the developing roller is set such that the tilt direction of the fringy ridges may be opposite to the rotational direction of the developing roller, thereby overcoming the problems associated with a coefficient of friction. Since an appropriate coefficient of friction is provided to ensure satisfactory triboelectric charging, there are produced images of quality free of density variations, background fog and character thinning even after long-term service.

More particularly, in developing a latent image by causing a developing roller to carry a toner on its outer surface to form a thin layer of the toner, causing a drum to bear an electrostatic latent image on its surface, and rotating the developing roller and the drum while placing the roller in proximity to or in contact with the drum, thereby supplying the toner to the latent image-bearing surface of the drum to develop the latent image into a toner image, it is possible to have an adequate coefficient of friction on the developing roller and hence achieve satisfactory triboelectric charging by providing the developing roller on the surface with a number of fine fringy ridges. In this regard, it is convenient for a coefficient of friction and triboelectric charging that the fine fringy ridges are tilted in one circumferential direction which is opposite to the rotational direction of the developing roller. There are produced images of quality free of density variations, background fog and character thinning even after long-term service.

Accordingly, in a fourth aspect, the present invention provides a method for developing a latent image comprising the steps of: causing a developing roller comprising a conductive layer around a highly conductive shaft to carry a developer on its outer surface to form a thin film of the developer; causing a drum to bear an electrostatic latent image on its surface; and rotating the developing roller and the drum while placing the roller in proximity to or in contact with the drum, thereby supplying the developer to the latent image-bearing surface of the drum to develop the latent image into a toner image. The method further includes the steps of providing the developing roller on the surface with a number of fine fringy ridges which are tilted in one circumferential direction and setting the developing roller such that the tilt direction of the fringy ridges may be opposite to the rotational direction of the developing roller.

The present invention also provides an apparatus for developing a latent image comprising a rotatable drum adapted to bear an electrostatic latent image on its surface; a rotatable developing roller comprising a conductive layer around a highly conductive shaft, the developing roller being disposed in proximity to or in contact with the drum; means for supplying a developer to the developing roller to form a thin film of the developer on its outer surface; means for rotating the developing roller and the drum in proximate or close relationship; wherein the developer is supplied to the latent image-bearing surface of the drum to develop the latent image into a toner image; the developing roller being provided on the surface with a number of fine fringy ridges which are tilted in one circumferential direction and the developing roller being set such that the tilt direction of the fringy ridges may be opposite to the rotational direction of the developing roller.

BRIEF DESCRIPTION OF THE DRAWINGS

The above and other objects, features and advantages of the present invention will be better understood by reading the following description taken in conjunction with the accompanying drawings.

BEST MODE FOR CARRYING OUT THE INVENTION

Figure 1:
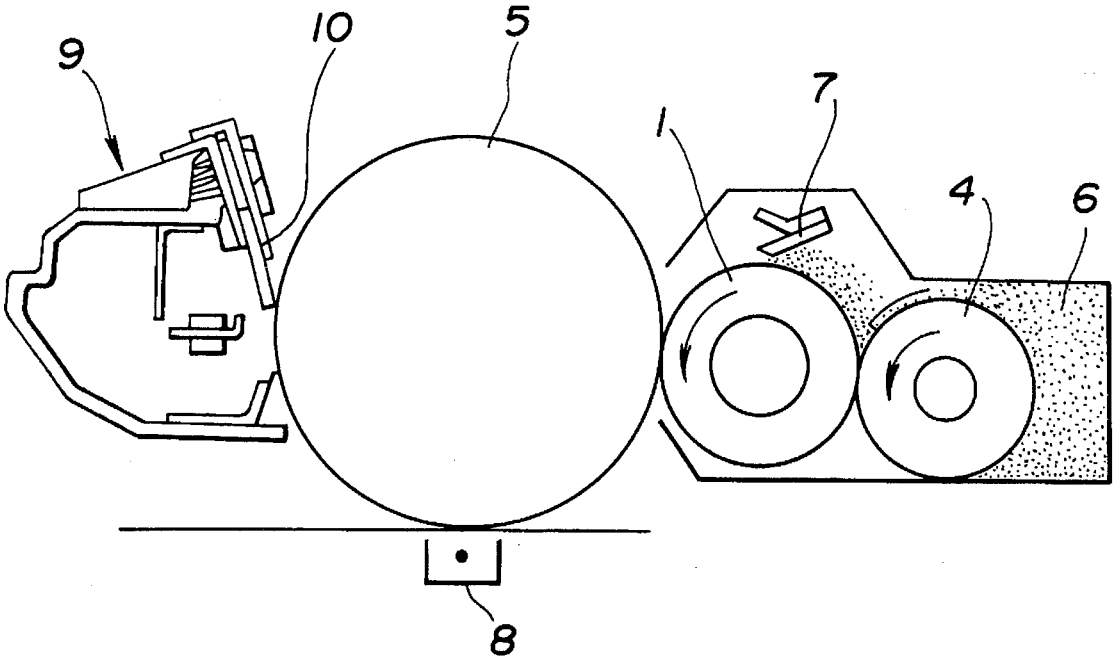
FIG. 1 schematically illustrates an electrophotographic system to which the present invention is applicable.
Figure 2:
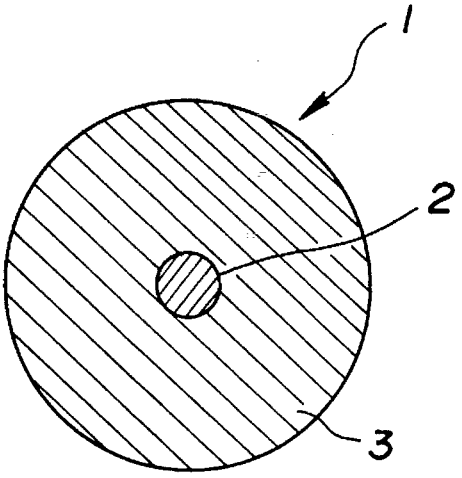
FIG. 2 is a schematic cross-sectional view of one exemplary developing roller.

Referring to FIG. 2, a developing roller 1 according to the present invention is illustrated as comprising a highly conductive shaft 2 and an annular conductive layer 3 around the shaft. The developing roller 1 is used as shown in FIG. 1 for supplying toner 6 to a photoconductor or photosensitive drum 5 to develop an electrostatic latent image on the drum into a visible toner image.

The shaft 2 may be made of any material having high conductivity and is typically a metallic shaft, for example, solid metal cores and hollow metal cylinders.

The conductive layer 3 may be formed by applying a composition comprising any desired resin, conductive powder and magnetic powder or an electroconductive resin to the metal shaft to form a conductive resin cover and grinding its surface if the developing roller 1 is not contacted with the photoconductor drum 5. If the developing roller 1 is contacted with the photoconductor drum 5, a relatively flexible elastomer is used to form the conductive layer 3 in order to provide for a developing nip.

For the conductive layer 3, conductive rubbers or elastomer or foam materials such as polyurethane are used.

The conductive layer 3 made of a conductive rubber composition is first described. The rubber materials may be either expanded or unexpanded. Examples of the unexpanded rubber include conventional rubbers such as nitrile-butadiene rubber, natural rubber, butyl rubber, nitrile rubber, isoprene rubber, polybutadiene rubber, silicone rubber, styrene-butadiene rubber, ethylene-propylene rubber, ethylene-propylene-diene terpolymer rubber (EPDM), chloroprene rubber, acrylic rubber, and polynorbornene rubber; and thermoplastic rubbers such as styrene-butadiene-styrene (SBS) and hydrogenated styrene-butadiene-styrene (SEBS), and mixtures thereof. Examples of the expanded rubber include ethylene-propylene-diene terpolymer rubber (EPDM), chloroprene rubber, chlorosulfonated polyethylene, and epichlorohydrin-ethylene oxide copolymers.

Next, the conductive layer 3 made of a polyurethane composition is described. Polyurethane foams and elastomers may be formed by various methods, for example, by blending carbon black in a urethane prepolymer and subjecting the prepolymer to crosslinking reaction, or by blending a conductive agent in a polyol and reacting the polyol with a polyisocyanate by a one-shot technique.

The polyurethane as a base of the polyurethane composition is generally prepared from a polyhydroxyl compound and a polyisocyanate compound. As the polyhydroxyl compound, use may be made of polyols commonly used in the preparation of flexible polyurethane foams and urethane elastomers, such as polyether polyols terminated with a polyhydroxyl group, polyester polyols, and polyether polyols obtained by copolymerizing the former two; and other conventional polyols, for example, polyolefin polyols such as polybutadiene polyols and polyisoprene polyols, and polymer polyols obtained by polymerizing ethylenically unsaturated monomers in polyols. Examples of the polyisocyanate compound include polyisocyanates commonly used in the preparation of flexible polyurethane foams and urethane elastomers, such as tolylene diisocyanate (TDI), crude TDI, diphenylmethane-4,4'-diisocyanate (MDI), crude MDI, aliphatic polyisocyanates having 2 to 18 carbon atoms, alicyclic polyisocyanates having 4 to 15 carbon atoms, and mixtures and modified products of these polyisocyanates, e.g., prepolymers partially reacted with polyols. Preferably in the case of polyurethane, a polyol components is previously reacted with an isocyanate to form a prepolymer.

Conductive agents are blended in these rubbers or the polyurethane. Examples of the conductive agent include conductive carbon such as Ketjen Black EC and acetylene black; carbon for rubber such as SAF, ISAF, HAF, FEF, GPF, SRF, FT, and MT; oxidized carbon for color ink; pyrolytic carbon; natural graphite, synthetic graphite; metals and metal oxides such as antimony-doped tin oxide, titanium oxide, zinc oxide, nickel, copper, silver and germanium; conductive polymers such as polyaniline, polypyrrole, and polyacetylene; ionic conductive agents, for example, inorganic ionic materials such as lithium perchlorate and sodium perchlorate, and organic ionic materials such as quaternary ammonium salts; cationic surfactants; anionic surfactants; ampholytic surfactants such as betaines; and nonionic antistatic agents such as hydrophilic polyethers and polyesters. The amount of conductive agent blended may be determined to give an appropriate resistance depending on the type of conductive agent although it is preferably about 0.001 to 50 parts, more preferably about 0.001 to 5 parts by weight per 100 parts by weight of these rubbers or the polyurethane. Then the conductive layer may have a volume resistivity of $10^2$ to $10^{10}$ Ω.cm. Other useful conductive agents include electron acceptors capable of forming a charge transfer complex, such as tetracyanoethylene, tetracyanoquinodimethane, benzoquinone, chloroanil, anthraquinone, anthracene, dichlorodicyanobenzoquinone, ferrocene, and phthalocyanine. The electron acceptors are blended in amounts of about 0.001 to 20 parts, more preferably about 0.01 to 1 parts by weight per 100 parts by weight of these rubbers or the polyurethane.

No particular limit is imposed on the hardness of the conductive layer 3. Where the developing roller 1 is operated in contact with the photoconductor drum 5, the conductive layer on the surface should preferably have a hardness of up to 60°, more preferably 10° to 55° on JIS A hardness scale. With a hardness of more than 60°, a less contact area would be available between the developing roller and the photoconductor drum, failing to achieve satisfactory development. A too low hardness leads to an increased compression set, which means that the developing roller can be deformed or eccentric for some reason or other, resulting in images having density variations. Then, where the elastomer layer has a low hardness, its compression set should preferably be as low as possible, typically 20% or lower.

Figure 3:
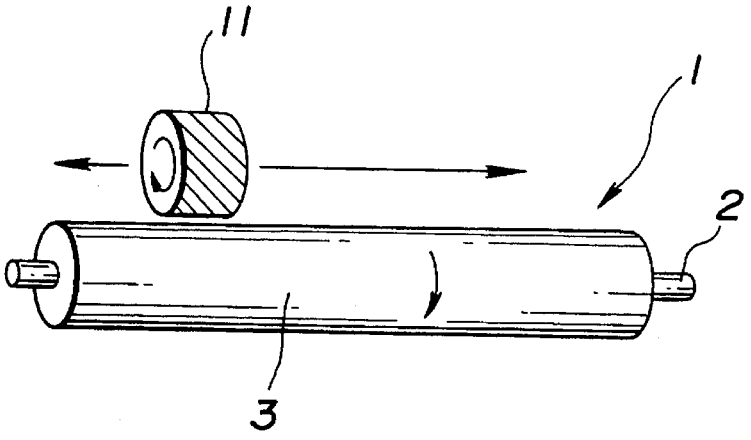
FIG. 3 schematically illustrates a grinding method.

The developing roller of the present invention has microscopic irregularities on the surface of the conductive layer. The surface of the conductive layer may be rugged by any desired technique, typically wet and dry grinding techniques. A dry grinding technique is preferred. FIG. 3 illustrates one exemplary technique of grinding the developing roller according to the invention. The developing roller 1 is rotated at about 100 rpm in the direction of the arrow. An abrasive wheel 11 is rotated at about 1,500 rpm in the arrow direction. With the abrasive wheel 11 set in contact with the roller 1, the abrasive wheel 11 is axially moved from one end to another end, thereby grinding the roller 1 on the surface. Instead of the axial travel of the abrasive wheel, an abrasive cylinder having an axial length corresponding to the roller may be used whereby grinding is accomplished by rotating the abrasive wheel and the roller without axial travel. Also acceptable is a wet grinding technique of accomplishing grinding while injecting lubricant fluid such as water and oil between the abrasive wheel and the roller (conductive layer).

Alternatively, a developing roller having a rugged surface may be formed by molding, typically injection molding. A mold is provided on the internal cavity surface with microscopic irregularities and the rubber or polyurethane composition is injected therein.

According to the first embodiment of the invention, the conductive layer has an outer surface which is rugged, typically by a grinding step as mentioned above. This rugged surface has a core roughness depth Rk in a circumferential direction and a core roughness depth Rk in an axial direction of the roller as prescribed in DIN 4776 standard. The circumferential Rk is 0.5 to 3.5 μm and the ratio of the circumferential Rk to the axial Rk is greater than 1.0.

Figure 12:
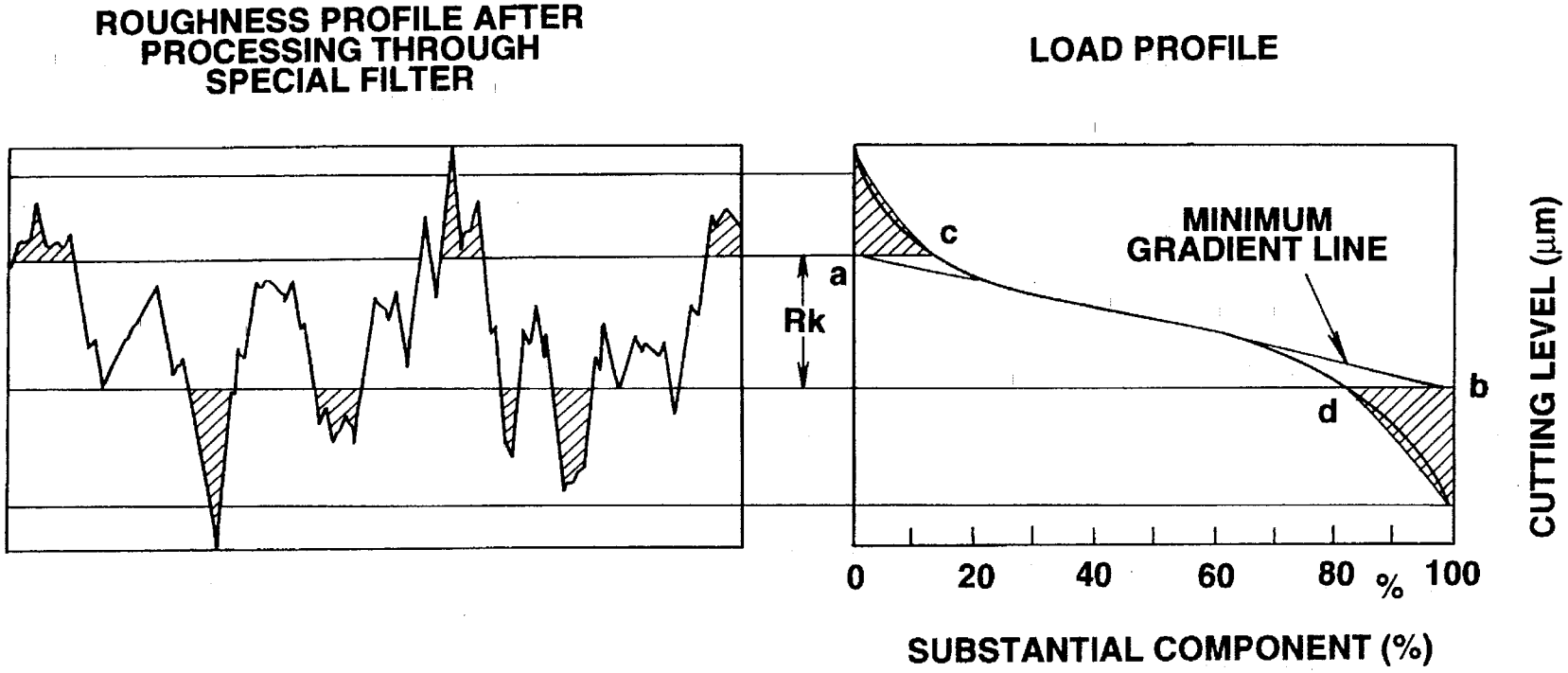
FIG. 12 illustrates roughness and load profiles for explaining core roughness depth Rk according to DIN 4776.

The term core roughness depth Rk used herein is prescribed in DIN 4776 and is briefly described in conjunction with FIG. 12. It is determined by converting a roughness profile measured on a surface into a load profile, defining a width of 40% on the load profile in a direction of tp value, searching the position at which the difference between the heights at opposite ends is minimum, to depict a minimum gradient line, determining the intersection a between the minimum gradient line and a boundary line at tp=0%, a horizontal line from the intersection a intersecting with the load profile at c, and determining the intersection b between the minumum gradient line and a boundary line at tp=100% a horizontal line from the intersection b intersecting with the load profile at d. The difference (μm) in height between the intersections c and d is the core roughness depth Rk. This value generally represents the height of peaks abraded over a long time.

Figure 4:
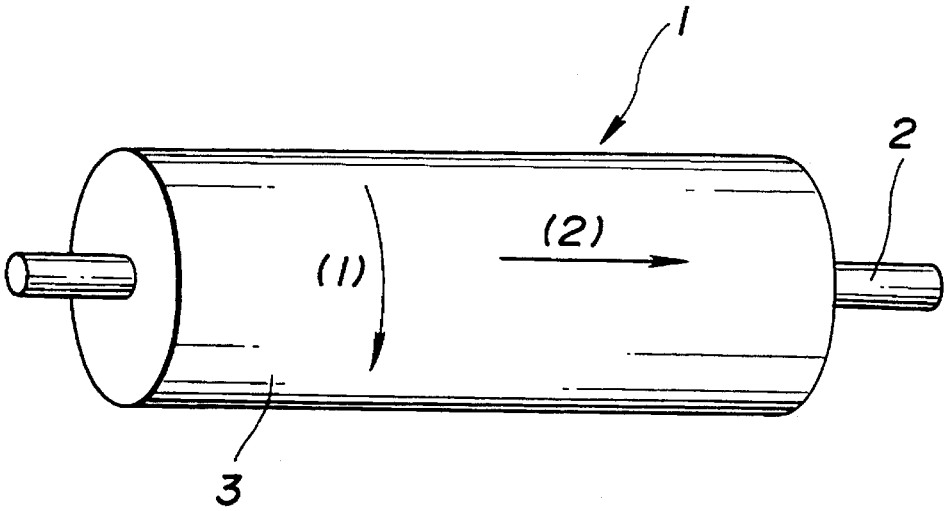
FIG. 4 is a schematic view of a developing roller showing axial and circumferential directions associated with surface roughness.

The direction of surface roughness is described in conjunction with FIG. 4. Reference should also be made to DIN 4776 standard. The DIN 4776 core roughness depth Rk in a circumferential direction (simply referred to as circumferential Rk) is a surface roughness as measured by sweeping a probe type surface roughness meter in contact with the conductive layer surface in a circumferential direction denoted by arrow (1) in FIG. 4. The DIN 4776 core roughness depth Rk in an axial direction (simply referred to as axial Rk) is a surface roughness as measured by sweeping the roughness meter in an axial direction denoted by arrow (2) in FIG. 4. It is noted that the circumferential and axial directions are perpendicular to each other and the circumferential direction is also referred to as a rotational direction of the roller.

With too great of a surface roughness, the amount of toner carried on the roller is increased to form a thicker layer of toner on the roller. Since toner particles are individually charged, a thicker layer of toner has a greater quantity of charge and thus exhibits a higher surface potential in the vicinity to the photoconductor. When a predetermined bias voltage is applied across the developing roller to cause the toner to leap to the photoconductor during the development process, the roller surface layer is at a higher potential than the bias voltage due to the excess charge the toner layer possesses. Then during the reversal development process, for example, the surface potential of the developing roller does not fall between the dark decay potential and the charging potential on the photoconductor, but increases beyond the photoconductor charging potential, causing the toner to scatter to white areas to invoke image fogging (referred to as high charged toner fog).

Inversely, a too smaller surface roughness leads to a smaller amount of toner carried on the roller and less triboelectric charging and hence, a smaller quantity of toner charge. Then the toner carried on the roller contains weakly or reversely charged toner portions, which will scatter to white areas to invoke background fogging in the case of reversal development.

According to the second embodiment of the invention, the conductive layer of the developing roller has an outer surface which is rugged, typically by a grinding step as mentioned above. This rugged surface is provided with microscopic ridges and recesses which are alternately disposed in the rotational direction to form wavy streaks. The wavy streaks have a longitudinal direction substantially aligned with an axial direction.

In one preferred embodiment, provided that the conductive layer of the developing roller has a ten point mean roughness Rz in both axial and rotational directions according to JIS B-0601, the roughness Rz in rotational direction is greater than the roughness Rz in axial direction. This ensures that the roller carries a consistent amount of toner. After a durability test, occurrence of image variations is effectively suppressed.

Figure 13:
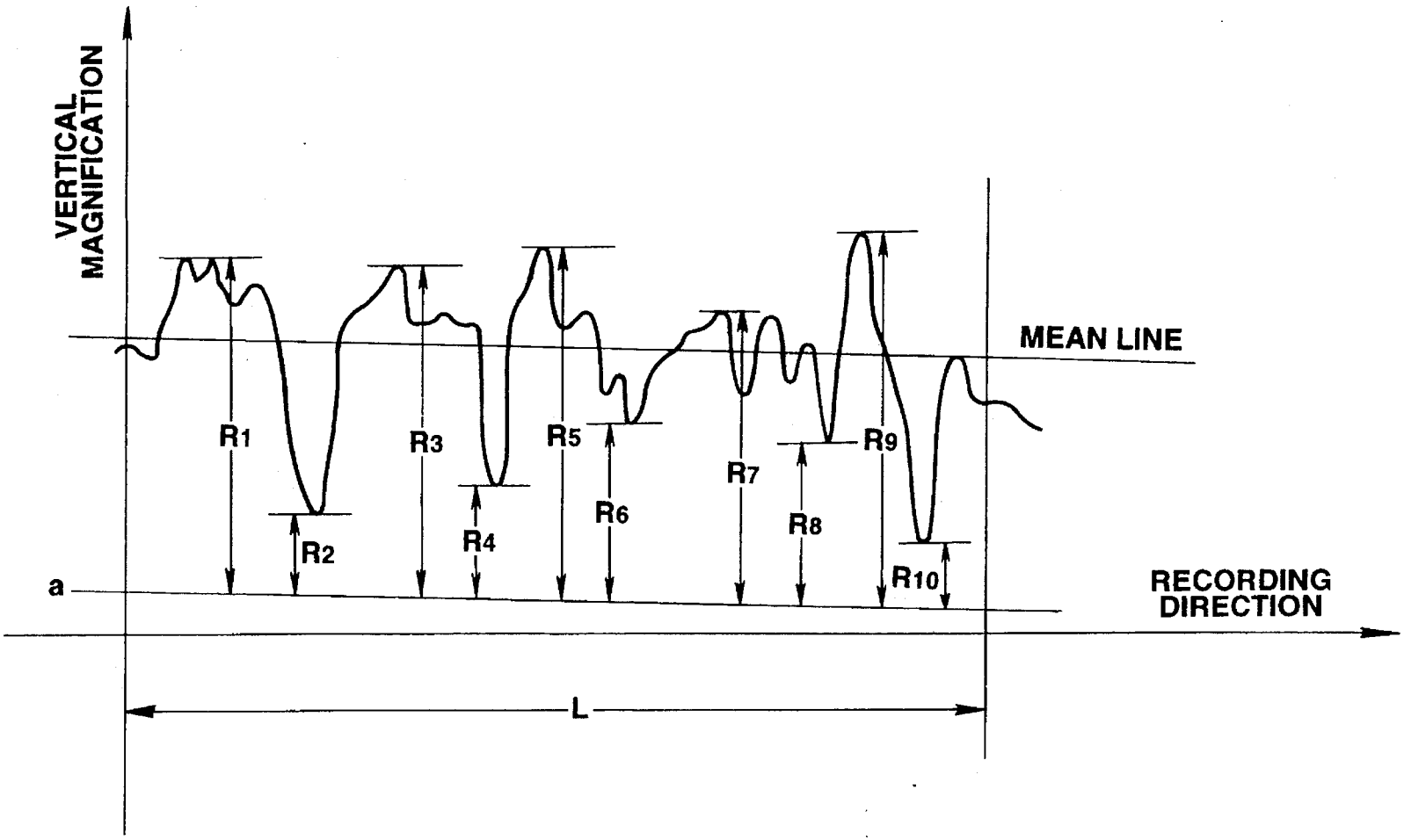
FIG. 13 illustrates a roughness profile for explaining ten-point mean roughness Rz according to JIS B-0601.

The term surface roughness Rz used herein is a ten-point mean surface roughness by JIS B 0601-1982. The terms, surface roughness, profile, reference length of profile, roughness curve, cut-off value, mean line of profile, and profile peak and valley are as defined in the standard. In FIG. 13, the ten-point mean roughness shall be the value of difference, being expressed in micrometer (μm), between the mean value of altitudes of peaks from the highest to the 5th, measured in the direction of vertical magnification from a straight line a that is parallel to the mean line and that does not intersect the profile, and the mean value of altitudes of valleys from the deepest to the 5th, within a sampled portion, of which length corresponds to the reference length, from the profile. The profile may be depicted by means of a probe meter, for example.

The ten-point mean roughness Rz is given by the following equation:

$$Rz=[(R_1+R_3+R_5+R_7+R_9)-(R_2+R_4+R_6+R_8+R_{10})]/5$$

wherein $R_1$, $R_3$, $R_5$, $R_7$ and $R_9$ are altitudes of peaks from the highest to the 5th for the sampled portion corresponding to the reference length L, and $R_2$, $R_4$, $R_6$, $R_8$, and $R_{10}$ are altitudes of valleys from the deepest to the 5th for the samples portion corresponding to the reference length L. The reference length L varies with the range of the ten-point mean roughness Rz and it is also in conformity to the standard. For example, L=0.25 mm when Rz<0.8 μm, L=0.8 mm when 0.8 μm<Rz≦6.3 μm, L=2.5 mm when 6.3 μm<Rz≦25 μm, and so on.

It is noted that the ten point mean roughness Rz in a rotational direction is a surface roughness as measured by sweeping a probe type surface roughness meter in contact with the conductive layer surface in a circumferential or rotational direction denoted by arrow (1) in FIG. 4 and that the ten point mean roughness Rz in an axial direction is as measured by sweeping the roughness meter in an axial direction denoted by arrow (2) in FIG. 4.

In a further preferred embodiment, the ridges have a height of about 0.1 to 30 μm relative to the recesses and the wavy streaks are separated at an average spacing of about 1 to 500 μm.

According to the third and fourth embodiments of the invention, the microscopically rugged surface of the developing roller includes a number of fine fringy ridges which are tilted in one circumferential direction. These tilted fine fringy ridges can be formed by grinding the surface of the conductive layer by a grinding technique as mentioned above.

In this embodiment, the tilted fine fringy ridges preferably have a height of about 0.1 to 30 μm and are separated at an average spacing of about 1 to 500 μm, preferably about 1 to 200 μm. With respect to the roughness of the rugged surface, the ten point mean roughness Rz in circumferential direction is preferably greater than the roughness Rz in axial direction.

Figure 5:
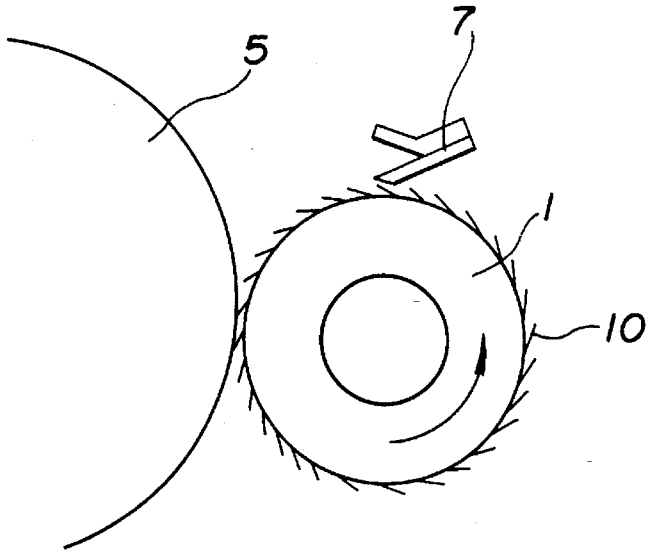
FIG. 5 is a schematic fragmental view illustrating a developing method and apparatus according to the invention, the roller having forward tilted ridges.

By setting the developing roller in the developing device such that the fine fringy ridges on the roller are tilted in one circumferential direction which coincides with the rotational direction of the roller, the amount of toner carried on the roller can be optimum and constant. As shown in FIG. 5, the developing roller 1 is set such that the tilting direction of fringy ridges 10 may be coincident with the rotational direction of the roller 1. In other words, the fringy ridges extend from the roller surface obliquely outward relative to a tangent and in the rotational direction of the roller. With this arrangement, by rotating the developing roller 1, it is possible to carry an adequate amount of toner on the developing roller 1 in cooperation with the regulating blade 7. The toner carrying capability ensures that the toner carried on the roller 1 is delivered to the latent image bearing body or photoconductor drum 5 to develop the latent image on the drum 5 into a toner image. There are produced images of quality free of density variations, background fog and character thinning even after long-term service.

Figure 6:
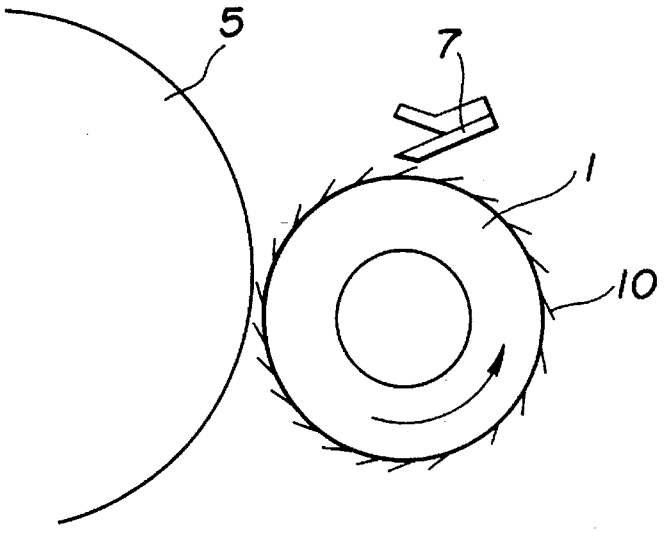
FIG. 6 is a schematic fragmental view illustrating a developing method and apparatus according to the invention, the roller having backward tilted ridges.

In contrast, if the developing roller is set such that the tilt direction of the fringy ridges may be opposite to the rotational direction of the developing roller, an appropriate coefficient of friction is available to ensure satisfactory triboelectric charging, precluding occurrence of image defects associated with short charging. As shown in FIG. 6, the developing roller 1 is set such that the tilting direction of fringy ridges 10 may be opposite to the rotational direction of the roller 1. In other words, the fringy ridges extend from the roller surface obliquely outward relative to a tangent and in the counter-rotational direction of the roller. With this arrangement, by rotating the developing roller 1, it is possible to provide a coefficient of friction and triboelectric charging sufficient to carry the toner on the roller 1 and deliver it to the latent image bearing body or photoconductor drum 5 to develop the latent image on the drum 5 into a toner image. There are produced images of quality free of density variations, background fog and character thinning even after long-term service.

In developing electrostatic latent images using the developing roller according to any of the above-mentioned embodiments of the invention, either a magnetic or non-magnetic one-component developer may be used as the developer. Better results are obtained with a non-magnetic one-component developer. When the developing roller 1 and the latent image bearing body or photoconductor drum 5 are rotated in a non-contact relationship, the spacing between the roller 1 and the drum 5 is preferably about 50 to 500 μm, more preferably about 100 to 300 μm. The rotational directions of the developing roller 1 and the photoconductor drum 5 may be identical or opposite while the rotational directions of the developing roller 1 and the toner feed roller 4 (see FIG. 1) may be identical or opposite. These rotational directions may be selected depending on various other conditions. The components other than the developing roller 1 of the developing apparatus including the latent image bearing body or photoconductor drum 5 and toner feed roller 4 may be conventional with respect to material, rotational speed, and other conditions.

There has been described a developing roller which is improved in surface state so as to achieve an acceptable toner carrying capability or coefficient of friction to produce images of quality free of density variations, background fog and character thinning even after long-term service.

EXAMPLE

Examples of the invention are given below by way of illustration and not by way of limitation. All parts are by weight.

Example 1

| Components | Parts |
|---|---|
| Polyether polyol obtained by adding propylene oxide and ethylene oxide to glycerin so as to give a molecular weight of 5,000 and an OH value of 33 (Excenol ® 828, Asahi Glass K.K.) | 100 |
| Urethane-modified MDI, NCO = 23% (Sumidur ® PF, Sumitomo Bayer Urethane K.K.) | 25.0 |
| 1,4-butane diol | 2.5 |
| Dibutyltin dilaurate | 0.01 |
| Quaternary ammonium (KS-555, Kao K.K.) | 0.25 |

These components were agitated to form a composition which was cast into a mold having a metal shaft placed therein. The composition was heated for curing at 110° C. for hours to form a conductive polyurethane layer around the shaft, obtaining a developing roller. The roller was dry ground under the conditions reported in Table 1. The ground roller was examined for surface state and physical properties. The results are shown in Table 1.

(1) Surface state

Using a surface roughness meter model Surfcom 570A (Tokyo Seimitsu K. K.), the roller was measured for DIN 4776 core roughness depth Rk in both circumferential and axial directions.

(2) Hardness

A sheet sample was prepared under the same conditions as each roller and measured for hardness according to JIS K-6301, A scale.

(3) Resistance

With a roller in pressure contact with an aluminum plate under a load of 500 g, a DC voltage of 100 V was applied across the aluminum plate and roller. Resistance was calculated from the resulting current value.

Example 2

A roller was prepared from the same composition as in Example 1, ground under the conditions reported in Table 1, and examined for surface state and physical properties. The results are shown in Table 1.

Comparative Example 1–3

Rollers were prepared from the same composition as in Example 1, ground under the conditions reported in Table 1, and examined for surface state and physical properties. The results are shown in Table 1.

TABLE 1

| | Abrasive grain size | Abrasive grain diameter, μm | Dressing rate, mm/min. | Circumferential Rk, μm | Axial Rk, μm | Rkc/Rka | Hardness, JIS A scale | Resistance, Ω |
|---|---|---|---|---|---|---|---|---|
| E1 | #80 | 300 | 300 | 2.8 | 2.6 | 1.08 | 45 | $2 \times 10^7$ |
| E2 | #120 | 200 | 150 | 0.8 | 0.6 | 1.33 | 45 | $2 \times 10^7$ |
| CE1 | #150 | 170 | 100 | 0.4 | 0.3 | 1.33 | 45 | $2 \times 10^7$ |
| CE2 | #80 | 300 | 600 | 2.5 | 2.9 | 0.86 | 45 | $2 \times 10^7$ |
| CE3 | #46 | 550 | 300 | 4.0 | 3.3 | 1.21 | 45 | $2 \times 10^7$ |

Rkc/Rka = circumferential Rk/axial Rk

The developing rollers of Examples 1–2 and Comparative Examples 1–3 were examined by the following image quality tests and charging tests. The results are shown in Table 2.

(1) Image

A developing roller was mounted in a developing unit of an electrophotographic system as shown in FIG. 1. The system was operated for reversal development by using a non-magnetic one-component toner having a mean particle size of 7 μm and rotating the developing roller at a circumferential linear speed of 60 mm/sec. The initial image quality was evaluated in terms of the following two fog factors.

(a) High charged toner fog

A DC voltage was applied across the regulating blade in the system of FIG. 1 and swept to a negative level to determine the potential at which fog occurred. The more negative the fog occurrence potential, the better is the roller performance against High charged toner fog.

(b) Background fog

With a developing bias voltage fixed at 0 V in the system of FIG. 1, it was observed whether or not background fog occurred. The blade bias voltage was −100 V.

(c) Density variation

The image printed under the above-mentioned conditions was visually observed for density.

(2) Toner charging quantity

A developing roller was mounted in a developing unit of an electrophotographic system as shown in FIG. 1. The system was operated by rotating the developing roller at a circumferential speed of 50 mm/sec. to form a uniform thin layer of toner on the surface. The thin layer of toner was pneumatically sucked into a Faraday gage for measuring a charge quantity.

(3) Amount of toner carried

A thin layer of toner was formed on the roller surface as in (2) and wiped with a non-woven fabric having a given weight. The amount of toner carried on the roller was calculated from the weight of the toner-wiped fabric.

TABLE 2

| | High charged toner fog generating potential, V | Background fog | Density variation | Toner charging quantity, μC/g | Amount of toner carried, g/cm² |
|---|---|---|---|---|---|
| Example 1 | −1000 | good | good | 7.45 | 7.32 E-4 |
| Example 2 | −1200 | good | good | 7.31 | 6.82 E-4 |
| CEI | −1200 | rejected | low density | 6.02 | 4.51 E-4 |
| CE2 | −800 | fair | good | 7.60 | 8.66 E-4 |
| CE3 | −300 | rejected | good | 6.98 | 1.45 E-3 |

Example 3

| Components | Parts |
|---|---|
| Polyether polyol obtained by adding propylene oxide and ethylene oxide to glycerin so as to give a molecular weight of 5,000 and an OH value of 33 (Excenol ® 828, Asahi Glass K.K.) | 100 |
| Urethane-modified MDI, NCO = 23% (Sumidur ® PF, Sumitomo Bayer Urethane K.K.) | 25.0 |
| 1,4-butane diol | 2.5 |
| Dibutyltin dilaurate | 0.01 |

These components were agitated to form a composition which was cast into a mold having a metal shaft placed therein. The composition was heated for curing at 110° C. for 2 hours to form a conductive polyurethane layer around the shaft, obtaining a developing roller. The roller was dry ground under a set of conditions reported in Table 3.

TABLE 3

| | |
|---|---|
| Grinding machine | Traversing cylindrical grinding machine |
| Abrasive wheel | |
| Type | Porous abrasive wheel with a grain size of #80 to #150, Teiken K.K. |
| Revolution | 1,500 rpm |
| Work revolution | 100 rpm |
| Traversing speed | about 3 mm/sec. |

Figure 7:
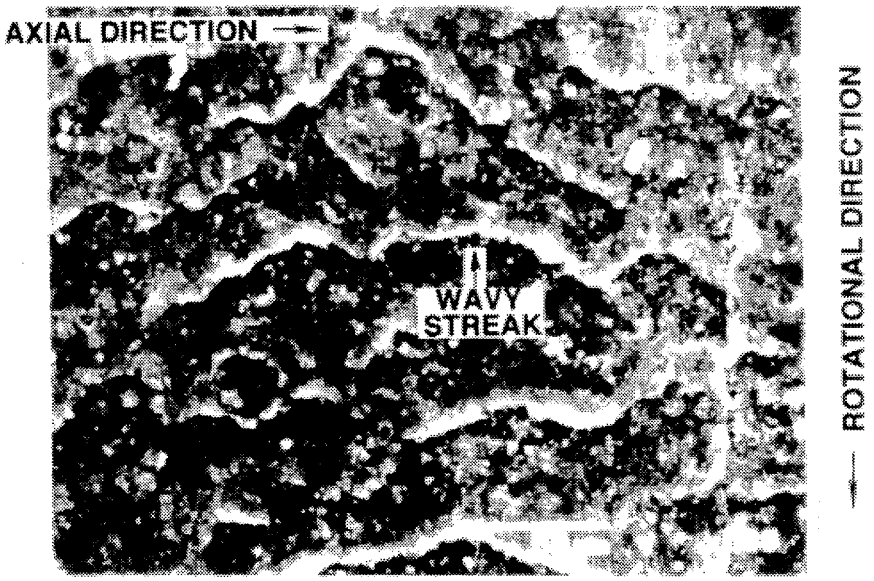
FIG. 7 is an electron photomicrograph of a rugged surface of the developing roller of Example 3.

The ground roller was observed for surface state under an electron microscope. FIG. 7 is a photomicrograph (magnifying power X500) of the surface of the conductive layer which shows that the surface had wavy streaks whose longitudinal direction substantially aligned with an axial direction of the roller.

Example 4

| Components | Parts |
|---|---|
| Polyether prepolymer prepared by reacting a polyether polyol obtained by adding propylene oxide and ethylene oxide to glycerin so as to give a molecular weight of 5,000 and an OH value of 33 (Excenol ® 828, Asahi Glass K.K.) with tolylene diisocyanate (TDI-80, NCO = 23%, Sumitomo Bayer Urethane K.K.) | 100 |
| Asahi Thermal FT (Asahi Carbon K.K.) | 3.0 |
| 1,4-butane diol | 6.9 |
| Dibutyltin dilaurate | 0.05 |
| Quaternary ammonium (KS-555, Kao K.K.) | 0.2 |

These components were agitated to form a composition which was cast into a mold having a metal shaft placed therein. The composition was heated for curing at 110° C. for hours to form a conductive polyurethane layer around the shaft, obtaining a developing roller. The roller was dry ground under the set of conditions reported in Table 3.

Figure 8:
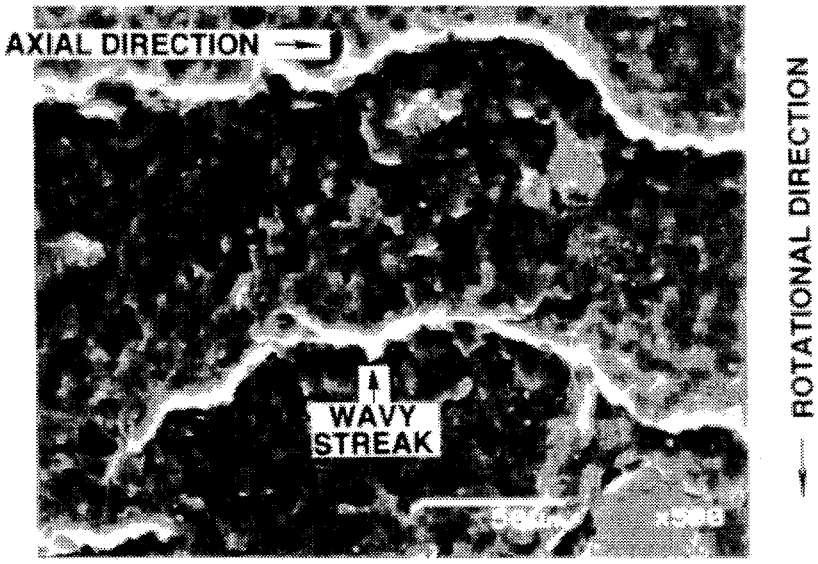
FIG. 8 is an electron photomicrograph of a rugged surface of the developing roller of Example 4.

The ground roller was observed for surface state under an electron microscope. FIG. 8 is a photomicrograph (magnifying power X500) of the surface of the conductive layer which shows that the surface had wavy streaks whose longitudinal direction substantially aligned with an axial direction of the roller.

Comparative Example 4

The roller was prepared from the same composition as in Example 3 and wet ground under the set of conditions reported in Table 3.

Figure 9:
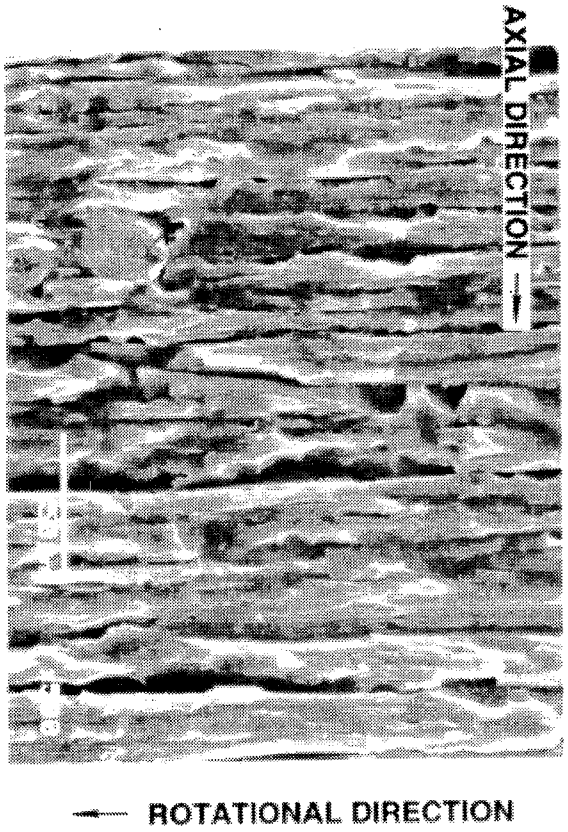
FIG. 9 is an electron photomicrograph of a rugged surface of the developing roller of Comparative Example 4.

The ground roller was observed for surface state under an electron microscope. FIG. 9 is a photomicrograph (magnifying power X500) of the surface of the conductive layer which shows that the rugged surface was different from that of Example 3.

Comparative Example 4

The roller was prepared from the same composition as in Example 4 and wet ground under the set of conditions reported in Table 3.

Figure 10:
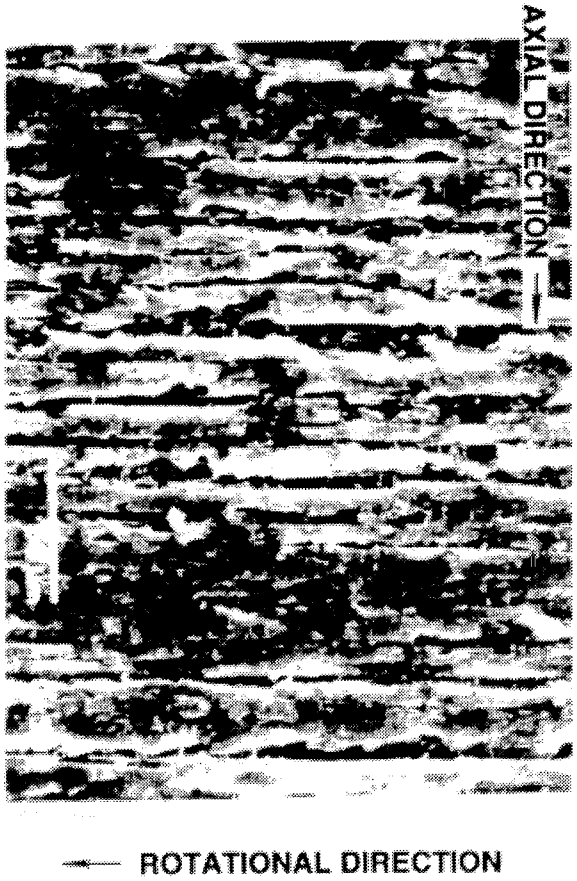
FIG. 10 is an electron photomicrograph of a rugged surface of the developing roller of Comparative Example 5.

The ground roller was observed for surface state under an electron microscope. FIG. 10 is a photomicrograph (magnifying power X500) of the surface of the conductive layer which shows that the rugged surface was different from that of Example 4.

The developing rollers of Examples 3–4 and Comparative Examples 4–5 were examined by the following tests. The results are shown in Table 4.

(1) Mean roughness Rz

Using a surface roughness meter model Surfcom 570A (Tokyo Seimitsu K. K.), the roller was measured for ten point mean roughness Rz in both rotational and axial directions.

(2) Ridge geometry

The spacing between wavy streaks was determined from the photomicrograph. The height of ridges was determined from a profile curve as depicted in (1).

(3) Hardness

A sheet sample was prepared under the same conditions as each roller and measured for hardness according to JIS K-6301, A scale.

(4) Image

A developing roller was mounted in a developing unit of an electrophotographic system as shown in FIG. 1. The system was operated for reversal development by using a non-magnetic one-component toner having a mean particle size of 7 μm and rotating the developing roller at a circumferential linear speed of 60 mm/sec. The image quality was evaluated in terms of sharpness, density variation and fog at the initial use and after 10,000 copies.

(5) Toner charging quantity

A developing roller was mounted in a developing unit of an electrophotographic system as shown in FIG. 1. The system was operated by rotating the developing roller at a circumferential speed of 50 mm/sec. to form a uniform thin layer of toner on the surface. The thin layer of toner was pneumatically sucked into a Faraday gage for measuring a charge quantity.

(6) Amount of toner carried

A thin layer of toner was formed on the roller surface as in (5) and pneumatically sucked over a given area. The weight of toner collected was measured.

TABLE 4

| | Rz, μm | | Ridge geometry | | | Image quality | Toner charge quantity, μC/g | | Amount of toner carried, mg/cm² | |
|---|---|---|---|---|---|---|---|---|---|---|
| | Rotational | Axial | Height, μm | Spacing, μm | Hardness, ° | after 10000 copies | Initial | After 10000 copies | Initial | After 10000 copies |
| E3 | 5.20 | 3.50 | 6.4 | 30 | 45 | good | −9.5 | −8.2 | 1.00 | 0.95 |
| E4 | 8.20 | 5.90 | 11.3 | 80 | 45 | good | −7.5 | −6.8 | 1.20 | 1.10 |
| CE4 | 2.70 | 6.70 | — | — | 45 | uneven, character fog | −8.5 | −11.2 | 0.86 | 0.55 |
| CE5 | 5.50 | 10.1 | — | — | 45 | uneven, character fog | −8.0 | −9.8 | 0.95 | 0.60 |

Example 5

| Components | Parts |
|---|---|
| Polyether polyol obtained by adding propylene oxide and ethylene oxide to glycerin so as to give a molecular weight of 5,000 and an OH value of 33 (Excenol ® 828, Asahi Glass K.K.) | 100 |
| Urethane-modified MDI, NCO = 23% (Sumidur ® PF, Sumitomo Bayer Urethane K.K.) | 25.0 |
| 1,4-butane diol | 2.5 |
| Dibutyltin dilaurate | 0.01 |
| A solution of 33% sodium perchlorate in diethylenglycol monomethyl ether | 0.2 |

These components were agitated to form a composition which was cast into a mold having a metal shaft placed therein. The composition was heated for curing at 110° C. for 2 hours to form a conductive polyurethane layer around the shaft, obtaining a developing roller. The roller was subject to dry grinding.

Figure 11:
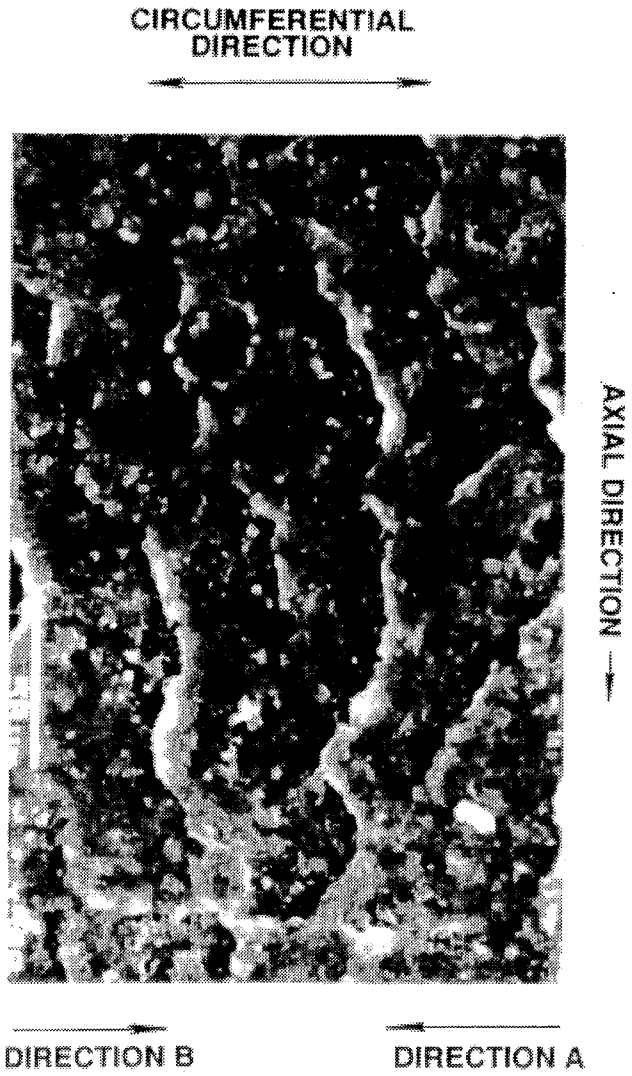
FIG. 11 is an electron photomicrograph of a rugged surface of the developing roller of Example 5.

The ground roller was observed for surface state under an electron microscope. FIG. 11 is a photomicrograph (magnifying power X500) of the surface of the conductive layer which shows that the surface had wavy streaks consisting of microscopic ridges. The surface was obliquely observed from directions A and B in FIG. 11. It was found that the wavy pattern was formed by fringy ridges which tilted in direction A in FIG. 11 or one circumferential direction of the roller.

The developing roller was mounted in a developing unit of an electrophotographic system as shown in FIG. 1 such that the direction A in FIG. 11 (that is, the tilt direction of fringy ridges on the roller surface) coincided with the rotational direction of the roller. The system was operated for reversal development by using a non-magnetic one-component toner having a mean particle size of 7 μm and rotating the developing roller at a circumferential linear speed of 60 mm/sec. Image quality, density, amount of toner carried, toner charge quantity were examined at the initial use and after 10,000 copies.

Example 6

| Components | Parts |
|---|---|
| Polyether prepolymer prepared by reacting a polyether polyol obtained by adding propylene oxide and ethylene oxide to glycerin so as to give a molecular weight of 5,000 and an OH value of 33 (Excenol ® 828, Asahi Glass K.K.) with tolylene diisocyanate (TDI-80, NCO = 23%, Sumitomo Bayer Urethane K.K.) | 100 |
| Asahi Thermal FT (Asahi Carbon K.K.) | 3.0 |
| 1,4-butane diol | 6.9 |
| Dibutyltin dilaurate | 0.05 |
| Quaternary ammonium (KS-555, Kao K.K.) | 0.2 |

These components were agitated to form a composition which was cast into a mold having a metal shaft placed therein. The composition was heated for curing at 110° C. for 2 hours to form a conductive polyurethane layer around the shaft, obtaining a developing roller. The roller was subject to dry grinding. The ground roller was observed for surface state under an electron microscope to find fringy ridges as in Example 5.

The developing roller was mounted in a developing unit of an electrophotographic system and tested as in Example 5. The results are shown in Table 5. The test methods are described below.

(1) Mean roughness Rz

Using a surface roughness meter model Surfcom 570A (Tokyo Seimitsu K. K.), the roller was measured for ten point mean roughness Rz in both circumferential A and B directions (see FIG. 11) as well as in an axial direction.

(2) Ridge geometry

The spacing between wavy streaks (or ridges) was determined from the photomicrograph. The height of ridges was determined from a profile curve as depicted in (1).

(3) Hardness

A sheet sample was prepared under the same conditions as each roller and measured for hardness according to JIS K-6301, A scale.

(4) Image density

A developing roller was mounted in a developing unit of an electrophotographic system as shown in FIG. 1, which was operated to print a solid black image. The printed image was measured for density at selected nine points using a Macbeth densitometer RD 918122.

(5) Toner charging quantity

A developing roller was mounted in a developing unit of an electrophotographic system as shown in FIG. 1. The system was operated by rotating the developing roller at a circumferential speed of 50 mm/sec. to form a uniform thin layer of toner on the surface. The thin layer of toner was pneumatically sucked into a Faraday gage for measuring a charge quantity.

(6) Amount of toner carried

A thin layer of toner was formed on the roller surface as in (5) and pneumatically sucked over a given area. The weight of toner collected was measured.

(7) Image quality

Solid black, half-tone and character samples were printed out as in Example 5 and the printed images were visually observed for sharpness, density variation and fog.

Example 7

The developing roller prepared in Example 5 was mounted in a developing unit of an electrophotographic system as shown in FIG. 1 such that the direction A in FIG. 11 (that is, the tilt direction of fringy ridges on the roller surface) was opposite to the rotational direction of the roller. The system was operated for reversal development by using a non-magnetic one-component toner having a mean particle size of 7 μm and rotating the developing roller at a circumferential linear speed of 60 mm/sec. Image quality, density, amount of toner carried, toner charge quantity were examined at the initial and after 10,000 copies. The test methods are as described just above. The results are shown in Table 5.

Example 8

The developing roller prepared in Example 6 was mounted, operated, and tested as in Example 7. The results are shown in Table 5.

TABLE 5

| | Example 5 | Example 6 | Example 7 | Example 8 |
|---|---|---|---|---|
| Rz, μm | | | | |
| Axial | 5.5 | 7.5 | 5.5 | 7.5 |
| Circumferential A | 4.5 | 6.0 | 4.5 | 6.0 |
| Circumferential B | 6.5 | 8.0 | 6.5 | 8.0 |
| Ridge geometry | | | | |
| Height, μm | 6.5 | 11.0 | 6.5 | 11.0 |
| Spacing, μm | 25 | 70 | 25 | 70 |
| Hardness, ° | 45 | 45 | 45 | 45 |

TABLE 5-continued

| | Example 5 | Example 6 | Example 7 | Example 8 |
|---|---|---|---|---|
| Image density | | | | |
| Initial | 1.5 | 1.5 | 1.4 | 1.5 |
| After 10000 prints | 1.4 | 1.4 | 1.4 | 1.5 |
| Toner charge quantity, μC/g | | | | |
| Initial | −9.0 | −7.5 | −10.5 | −9.5 |
| After 10000 prints | −8.0 | −6.0 | −10.0 | −9.0 |
| Amount of toner carried | | | | |
| Initial | 0.85 | 1.00 | 0.75 | 0.87 |
| After 10000 prints | 0.80 | 0.91 | 0.90 | 0.85 |
| Image quality | | | | |
| Initial | good | good | good | good |
| After 10000 prints | good | good | good | good |

Japanese Patent Application Nos. 210041/1994, 323376/1994, 50524/1995 and 50525/1995 are incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A developing roller comprising a highly conductive shaft and a conductive layer formed around the shaft and defining a cylindrical outer surface, the surface of said conductive layer having a core roughness depth Rk of 0.5 to 3.5 μm in a circumferential direction of the roller and a core roughness depth Rk in an axial direction of the roller as prescribed in DIN 4776 standard, the ratio of the circumferential Rk to the axial Rk being greater than 1.0.

2. The developing roller of claim 1 wherein the roller on the surface is ground to provide the roughness.

3. The developing roller of claim 1 which is adapted to carry a non-magnetic one-component developer on its outer surface to form a thin film of the developer and contact with a latent image holder having an electrostatic latent image borne on its surface whereby the latent image is developed to form a toner image.

4. A developing roller comprising a highly conductive shaft and a conductive layer formed around the shaft and defining a cylindrical outer surface, said roller having an axis and adapted to rotate about the axis in a circumferential rotational direction, the surface of said conductive layer being provided with wavy streaks having a longitudinal direction substantially aligned with an axial direction, said wavy streaks comprising microscopic ridges and recesses alternately disposed in the rotational direction.

5. The developing roller of claim 4 wherein the roller on the surface is ground to provide the ridges and recesses.

6. The developing roller of claim 4 which is adapted to carry a non-magnetic one-component developer on its outer surface to form a thin film of the developer and contact with a latent image holder having an electrostatic latent image borne on its surface whereby the latent image is developed to form a toner image.

7. The developing roller of claim 4 wherein said conductive layer has a ten point mean roughness Rz in both axial and rotational directions, the roughness Rz in rotational direction being greater than the roughness Rz in axial direction.

8. The developing roller of claim 4 wherein the ridges have a height of 0.1 to 30 μm relative to the recesses and the wavy streaks are at an average spacing of 1 to 200 μm.

9. A method for developing a latent image comprising the steps of:

causing a developing roller comprising a conductive layer around a highly conductive shaft to carry a developer on its outer surface to form a thin film of the developer, causing a drum to bear an electrostatic latent image on its surface, and rotating the developing roller and the drum while placing the roller in proximity to or in contact with the drum, thereby supplying the developer to the latent image-bearing surface of the drum to develop the latent image into a toner image, said method further comprising the steps of providing said developing roller on the surface with a number of fine fringy ridges which are tilted in one circumferential direction and setting said developing roller such that the tilt direction of the fringy ridges may coincide with the rotational direction of said developing roller.

10. The method of claim 9 wherein the step of providing said developing roller on the surface with a number of fringy ridges includes grinding the surface of said developing roller.

11. The method of claim 9 wherein said developing roller on the surface has a ten point mean roughness Rz in both axial and circumferential directions, the circumferential roughness Rz being greater than the axial roughness Rz.

12. The method of claim 9 wherein the ridges have a height of 0.1 to 30 μm and are circumferentially separated at an average spacing of 1 to 500 μm.

13. The method of claim 9 wherein said developer is a non-magnetic one-component developer.

14. A method for developing a latent image comprising the steps of:

causing a developing roller comprising a conductive layer around a highly conductive shaft to carry a developer on its outer surface to form a thin film of the developer, causing a drum to bear an electrostatic latent image on its surface, and rotating the developing roller and the drum while placing the roller in proximity to or in contact with the drum, thereby supplying the developer to the latent image-bearing surface of the drum to develop the latent image into a toner image, said method further comprising the steps of providing said developing roller on the surface with a number of fine fringy ridges which are tilted in one circumferential direction and setting said developing roller such that the tilt direction of the fringy ridges may be opposite to the rotational direction of said developing roller.

15. The method of claim 14 wherein the step of providing said developing roller on the surface with a number of fringy ridges includes grinding the surface of said developing roller.

16. The method of claim 14 wherein said developing roller on the surface has a ten point mean roughness Rz in both axial and circumferential directions, the circumferential roughness Rz being greater than the axial roughness Rz.

17. The method of claim 14 wherein the ridges have a height of 0.1 to 30 μm and are circumferentially separated at an average spacing of 1 to 500 μm.

18. The method of claim 14 wherein said developer is a non-magnetic one-component developer.

19. An apparatus for developing a latent image comprising a rotatable drum adapted to bear an electrostatic latent image on its surface, a rotatable developing roller comprising a conductive layer around a highly conductive shaft, said developing roller being disposed in proximity to or in contact with said drum, means for supplying a developer to said developing roller to form a thin film of the developer on its outer surface, means for rotating said developing roller and said drum in proximate or close relationship, wherein the developer is supplied to the latent image-bearing surface of said drum to develop the latent image into a toner image, said developing roller being provided on the surface with a number of fine fringy ridges which are tilted in one circumferential direction and said developing roller being set such that the tilt direction of the fringy ridges may coincide with the rotational direction of said developing roller.

20. An apparatus for developing a latent image comprising a rotatable drum adapted to bear an electrostatic latent image on its surface, a rotatable developing roller comprising a conductive layer around a highly conductive shaft, said developing roller being disposed in proximity to or in contact with said drum, means for supplying a developer to said developing roller to form a thin film of the developer on its outer surface, means for rotating said developing roller and said drum in proximate or close relationship, wherein the developer is supplied to the latent image-bearing surface of said drum to develop the latent image into a toner image, said developing roller being provided on the surface with a number of fine fringy ridges which are tilted in one circumferential direction and said developing roller being set such that the tilt direction of the fringy ridges may be opposite to the rotational direction of said developing roller.

* * * * *